US006382331B1

(12) United States Patent
Pinckard

(10) Patent No.: US 6,382,331 B1
(45) Date of Patent: May 7, 2002

(54) METHOD OF AND SYSTEM FOR OPTIMIZING RATE OF PENETRATION BASED UPON CONTROL VARIABLE CORRELATION

(75) Inventor: Mitchell D. Pinckard, Lafayette, LA (US)

(73) Assignee: Noble Drilling Services, Inc., Sugar Land, TX (US)

( * ) Notice: Subject to any disclaimer, the term of this patent is extended or adjusted under 35 U.S.C. 154(b) by 0 days.

(21) Appl. No.: 09/550,928

(22) Filed: Apr. 17, 2000

(51) Int. Cl.[7] ..... E21B 44/00; E21B 7/00

(52) U.S. Cl. ..... 175/27; 175/57

(58) Field of Search ..... 175/24, 25, 27, 175/57, 94, 135; 704/216, 219; 395/2.1, 2.12, 2.16, 2.18

(56) References Cited

U.S. PATENT DOCUMENTS

| | | | | | |
|---|---|---|---|---|---|
| 2,688,871 | A | | 9/1954 | Lubinski | 73/151.5 |
| 3,777,560 | A | | 12/1973 | Guignard | 73/151.5 |
| 3,802,259 | A | | 4/1974 | Eckels | 73/153 |
| 3,872,932 | A | | 3/1975 | Gosselin | 175/26 |
| 3,881,695 | A | | 5/1975 | Joubert | 254/172 |
| 3,882,474 | A | | 5/1975 | Cain | 340/177 |
| 4,195,699 | A | | 4/1980 | Rogers et al. | 175/27 |
| 4,354,233 | A | | 10/1982 | Zhukovsky et al. | 364/420 |
| 4,535,972 | A | | 8/1985 | Millheim et al. | 254/277 |
| 4,695,957 | A | | 9/1987 | Peltier | 364/422 |
| 4,736,297 | A | | 4/1988 | Lejeune | 364/420 |
| 4,793,421 | A | | 12/1988 | Jasinski | 175/27 |
| 4,843,875 | A | | 7/1989 | Kerbart | 73/151.5 |
| 4,845,628 | A | | 7/1989 | Gray et al. | 364/420 |
| 4,875,530 | A | | 10/1989 | Frink et al. | 175/27 |
| 4,876,886 | A | | 10/1989 | Bible et al. | 73/151.5 |
| 4,886,129 | A | | 12/1989 | Bourdon | 175/40 |
| 5,231,484 | A | * | 7/1993 | Gonzales et al. | 358/133 |
| 5,398,546 | A | | 3/1995 | Jeffryes | 73/151.5 |
| 5,449,047 | A | | 9/1995 | Schivley, Jr. | 175/27 |
| 5,458,207 | A | | 10/1995 | Mattero | 175/27 |
| 5,474,142 | A | | 12/1995 | Bowden | 175/27 |
| 5,481,569 | A | * | 1/1996 | Conti et al. | 375/347 |
| 5,544,075 | A | * | 8/1996 | Janex | 364/514 |
| 5,551,286 | A | | 9/1996 | Booer | 73/152.45 |
| 5,713,422 | A | | 2/1998 | Dhindsa | 175/27 |
| 5,730,234 | A | | 3/1998 | Putot | 175/50 |
| 5,878,387 | A | * | 3/1999 | Oshikiri et al. | 704/207 |
| 6,021,377 | A | | 2/2000 | Dubinsky et al. | 702/9 |
| 6,026,912 | A | * | 2/2000 | King et al. | 175/27 |

* cited by examiner

*Primary Examiner*—Robert E. Pezzuto
(74) *Attorney, Agent, or Firm*—Pillsbury Winthrop LLP

(57) ABSTRACT

A method of and system for optimizing bit rate of penetration while drilling substantially continuously determine an optimum control variable value necessary to achieve an optimum bit rate of penetration based upon measured conditions and maintains control variable value at the optimum control variable value. As measured conditions change while drilling, the method updates the determination of optimum control variable value.

22 Claims, 7 Drawing Sheets

FIG. 7A

| 99a INDEX | 101a BIT_WT(t) | 103a BIT_ROP(t) | 105a BIT_ROP(t−1) |
|---|---|---|---|
| 1 | 23 | 47 | 48 |
| 2 | 24 | 48 | 49 |
| 3 | 26 | 49 | 46 |
| ⋮ | ⋮ | ⋮ | ⋮ |
| 30 | 24 | 48 | 46 |

FIG. 7B

| 99b INDEX | 101b PRES(t) | 103b BIT_ROP(t) | 105b BIT_ROP(t−1) |
|---|---|---|---|
| 1 | 3815 | 47 | 48 |
| 2 | 3945 | 48 | 49 |
| 3 | 3980 | 49 | 46 |
| ⋮ | ⋮ | ⋮ | ⋮ |
| 30 | 3890 | 48 | 46 |

FIG. 7C

| 99c INDEX | 101c TORQ(t) | 103c BIT_ROP(t) | 105c BIT_ROP(t−1) |
|---|---|---|---|
| 1 | 305 | 47 | 48 |
| 2 | 318 | 48 | 49 |
| | 323 | 49 | 46 |
| ⋮ | ⋮ | ⋮ | ⋮ |
| 30 | 310 | 48 | 46 |

METHOD OF AND SYSTEM FOR OPTIMIZING RATE OF PENETRATION BASED UPON CONTROL VARIABLE CORRELATION

CROSS-REFERENCE TO RELATED APPLICATION

The present application is related to application Ser. No. 09/053,955, filed Apr. 2, 1998, now U.S. Pat. No. 6,026,912, titled METHOD OF AND SYSTEM FOR OPTIMIZING RATE OF PENETRATION IN DRILLING OPERATIONS; application Ser. No. 09/158,338, filed Sep. 22, 1998, now U.S. Pat. No. 6,115,357, titled METHOD OF AND SYSTEM FOR OPTIMIZING RATE OF PENETRATION IN DRILLING OPERATIONS; application Ser. No. 09/398, 674, filed Sep. 17, 1999, now U.S. Pat. No. 6,293,356, titled METHOD OF AND SYSTEM FOR OPTIMIZING RATE OF PENETRATION IN DRILLING OPERATIONS; and application Ser. No. 09/484 478, filed Jan. 18, 2000, now U.S. Pat. No. 6,192,998, titled METHOD OF AND SYSTEM FOR OPTIMIZING RATE OF PENETRATION IN DRILLING OPERATIONS.

FIELD OF THE INVENTION

The present invention relates generally to earth boring and drilling, and more particularly to a method of and system for optimizing the rate of penetration in drilling operations.

DESCRIPTION OF THE PRIOR ART

It is very expensive to drill bore holes in the earth such as those made in connection with oil and gas wells. Oil and gas bearing formations are typically located thousands of feet below the surface of the earth. Accordingly, thousands of feet of rock must be drilled through in order to reach the producing formations.

The cost of drilling a well is primarily time dependent. Accordingly, the faster the desired penetration depth is achieved, the lower the cost in completing the well.

While many operations are required to drill and complete a well, perhaps the most important is the actual drilling of the bore hole. In order to achieve the optimum time of completion of a well, it is necessary to drill at the optimum rate of penetration. Rate of penetration depends on many factors, but a primary factor is weight on bit. As disclosed, for example in Millheim, et al., U.S. Pat. No. 4,535,972, rate of penetration increases with increasing weight on bit until a certain weight on bit is reached and then decreases with further weight on bit. Thus, there is generally a particular weight on bit that will achieve a maximum rate of penetration.

Drill bit manufacturers provide information with their bits on the recommended optimum weight on bit. However, the rate of penetration depends on many factors in addition to weight on bit. For example, the rate of penetration depends upon characteristics of the formation being drilled, the speed of rotation of the drill bit, and the rate of flow of the drilling fluid. Because of the complex nature of drilling, a weight on bit that is optimum for one set of conditions may not be optimum for another set of conditions.

One method for determining an optimum rate of penetration for a particular set of conditions is known as the "drill off test", disclosed, for example, in Bourdon, U.S. Pat. No. 4,886,129. Ignoring the effects of wall friction and hole deviation, as the drill string is lowered into the borehole, the entire weight of the drill string is supported by the hook. The drill string is somewhat elastic and it stretches under its own weight. When the bit contacts the bottom of the borehole, weight is transferred from the hook to the bit and the amount of drill string stretch is reduced. In a drill off test, an amount of weight greater than the expected optimum weight on bit is applied to the bit. While holding the drill string against vertical motion at the surface, the drill bit is rotated at the desired rotation rate and with the fluid pumps at the desired pressure. As the bit is rotated, the bit penetrates the formation. Since the drill string is held against vertical motion at the surface, weight is transfer from the bit to the hook as the bit penetrates the formation. By the application of Hooke's law, as disclosed in Lubinsky U.S. Pat. No. 2,688,871, the instantaneous rate of penetration may be calculated from the instantaneous rate of change of weight on bit. By plotting bit rate of penetration against weight on bit during the drill off test, the optimum weight on bit can be determined. After the drill off test, the driller attempts to maintain the weight on bit at that optimum value.

A problem with using a drill off test to determine an optimum weight on bit is that the drill off test produces a static weight on bit value that is valid only for the particular set of conditions experienced during the test. Drilling conditions are complex and dynamic. Over the course of time, conditions change. As conditions change, the weight on bit determined in the drill off test may no longer be optimum.

Another problem is that there may be substantial friction between the drill pipe or drill collars and the wall of the bore hole. This friction, in effect, supports part of the weight of the string and makes the apparent weight on bit determined from surface measurements higher than the actual weight on bit. The bore hole wall and pipe friction problem is exaggerated in highly deviated holes in which the long portions of the drill pipe lie on and are supported by the wall of a nearly horizontal bore hole. Also, in high friction environments, the pipe tends to stick at various depths, which effectively decouples the hook from the bit. Thus, the driller is less able to control the weight on bit while drilling. While it is weight that causes the bit to penetrate the earth, in high friction environments, it is difficult to determine the actual weight on bit from surface measurements.

It is therefore an object of the present invention to provide a method and system for providing, dynamically and in real time, an optimum rate of penetration for a particular set of conditions.

SUMMARY OF THE INVENTION

The present invention provides a method of and system for optimizing bit rate of penetration while drilling. The method substantially continuously collects bit rate of penetration, weight on bit, pump or standpipe pressure, and rotary torque data during drilling. The method stores bit rate of penetration, weight on bit, pressure, and torque data in respective data arrays. Periodically, the method performs a linear regression of the data in each of the data arrays with bit rate of penetration as a response variable and weight on bit, pressure, and torque, respectively, as explanatory variables to produce weight on bit, pressure, and torque slope coefficients. The method also calculates correlation coefficients for the relationships between rate of penetration, and weight on bit, pressure, and torque, respectively. The method then selects the drilling parameter, i.e., weight on bit, pressure, or torque, with the strongest correlation to rate on penetration as the control variable.

The method periodically searches the data array for the control variable to determine a maximum rate of penetration.

The depth of search into the data array is dependent on the value of the control variable slope coefficient. The more positive the control variable slope coefficient, the greater the depth of search into the data array. If the control variable slope coefficient is strongly negative, the method searches only a small distance into the data array.

The method bases the optimum control variable determination on a selected number of control variable values associated with the maximum rates of penetration within the depth of search and the control variable slope coefficient. The selected number depends on the depth of search. Generally, the greater the depth of search, the greater the selected number. If the selected number is greater than one, then the method averages the selected control variable values to obtain an average value. If the control variable slope coefficient is in a selected range near zero, the method sets the optimum control variable value at the average control variable value. If the control variable slope coefficient is greater than a selected positive value, the method sets the optimum control variable value at the average control variable value plus a selected increment. If the control variable slope coefficient is less than a selected negative value, the method sets the optimum control variable value at the weight on bit value minus a selected increment.

BRIEF DESCRIPTION OF THE DRAWINGS

FIGS. 7A–7C illustrate data arrays according to the present invention.

DESCRIPTION OF THE PREFERRED EMBODIMENT

Figure 1:
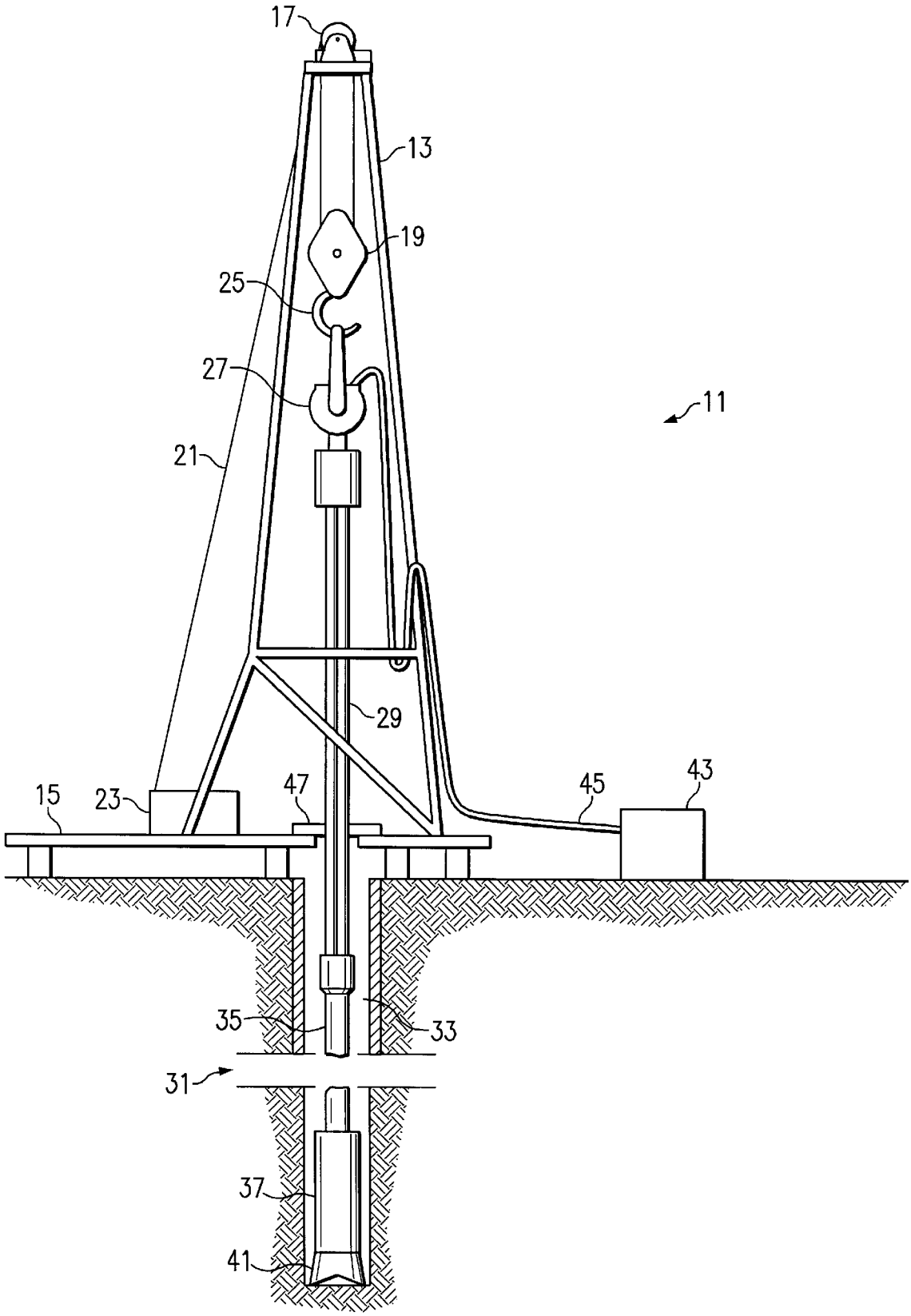
FIG. 1 is a pictorial illustration of a rotary drilling rig.

Referring now to the drawings and first to FIG. 1, a drilling rig is designated generally by the numeral 11. Rig 11 in FIG. 1 is depicted as a land rig. However, as will be apparent to those skilled in the art, the method and system of the present invention will find equal application to non-land rigs, such as jack-up rigs, semisubmersibles, drill ships, and the like. Also, although a conventional rotary rig is illustrated, those skilled in the art will recognize that the present invention is also applicable to other drilling technologies, such as top drive, power swivel, downhole motor, coiled tubing units, and the like.

Rig 11 includes a mast 13 that is supported on the ground above a rig floor 15. Rig 11 includes lifting gear, which includes a crown block 17 mounted to mast 13 and a traveling block 19. Crown block 17 and traveling block 19 are interconnected by a cable 21 that is driven by draw works 23 to control the upward and downward movement of traveling block 19. Traveling block 19 carries a hook 25 from which is suspended a swivel 27. Swivel 27 supports a kelly 29, which in turn supports a drill string, designated generally by the numeral 31 in a well bore 33. Drill string 31 includes a plurality of interconnected sections of drill pipe 35 a bottom hole assembly (BHA) 37, which includes stabilizers, drill collars, measurement while drilling (MWD) instruments, and the like. A rotary drill bit 41 is connected to the bottom of BHA 37.

Drilling fluid is delivered to drill string 31 by mud pumps 43 through a mud hose 45 connected to swivel 27. Drill string 31 is rotated within bore hole 33 by the action of a rotary table 47 rotatably supported on rig floor 15 and in nonrotating engagement with kelly 29.

Drilling is accomplished by applying weight to bit 41 and rotating drill string 31 with kelly 29 and rotary table 47. The cuttings produced as bit 41 drills into the earth are carried out of bore hole 33 by drilling mud supplied by mud pumps 43.

The rate of penetration during drilling is a function of the weight on bit. Generally, rate of penetration increases with increasing weight on bit up to a maximum rate of penetration for a particular drill bit and drilling environment. Further increased weight on bit beyond the weight corresponding to the maximum rate of penetration results in a decreased rate of penetration. Thus, for any particular drill bit and drilling environment, there is an optimum weight on bit.

As is well known to those skilled in the art, the weight of drill string 31 is substantially greater than the optimum weight on bit for drilling. Accordingly, during drilling, drill string 31 is maintained in tension over most of its length above BHA 37. The weight on bit is equal to the weight of string 31 in the drilling mud less the weight suspended by hook 25, and any weight supported by the wall of well bore 33.

Figure 2:
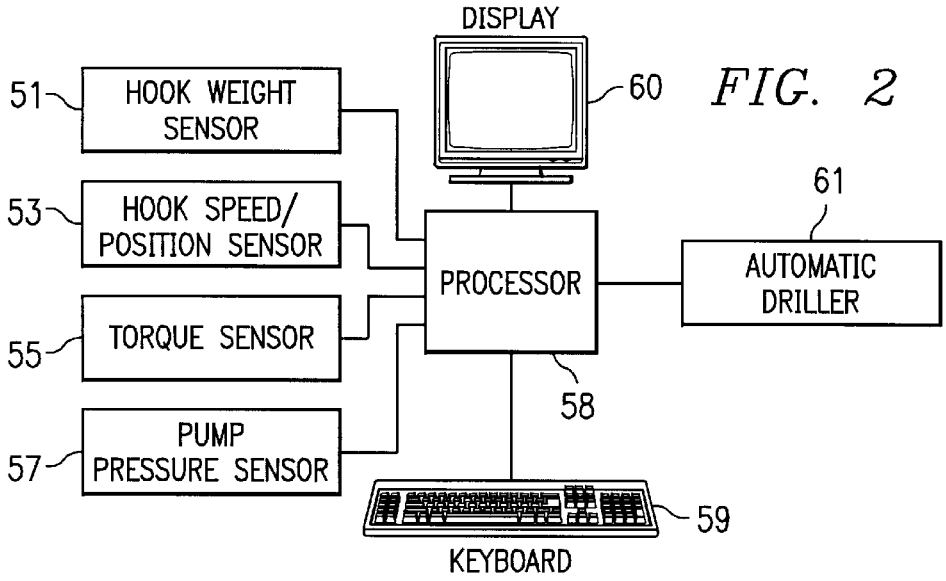
FIG. 2 is a block diagram of a system according to the present invention.

Referring now to FIG. 2, there is shown a block diagram of a preferred system of the present invention. The system includes a hook weight sensor 51. Hook weight sensors are well known in the art. They comprise digital strain gauges or the like, that produce a digital weight value at a convenient sampling rate, which in the preferred embodiment is five times per second although other sampling rates may be used. Typically, a hook weight sensor is mounted to the static line (not shown) of cable 21 of FIG. 1.

The weight on bit can be calculated by means of the hook weight sensor. As drill string 31 is lowered into the hole prior to contact of bit 41 with the bottom of the hole, the weight on the hook, as measured by the hook weight sensor, is equal to the weight of string 31 in the drilling mud. Drill string 31 is somewhat elastic. Thus, drill string 31 stretches under its own weight as it is suspended in well bore 33. When bit 41 contacts the bottom of bore hole 33, the stretch is reduced and weight is transferred from hook 25 to bit 41.

The driller applies weight to bit 41 effectively by controlling the height or position of hook 25 in mast 13. The driller controls the position of hook 25 by operating a brake to control the paying out cable from drawworks 23. Referring to FIG. 2, the system of the present invention includes a hook speed/position sensor 53. Hook speed sensors are well known to those skilled in the art. An example of a hook speed sensor is a rotation sensor coupled to crown block 17. A rotation sensor produces a digital indication of the magnitude and direction of rotation of crown block 17 at the desired sampling rate. The direction and linear travel of cable 21 can be calculated from the output of the hook position sensor. The speed of travel and position of traveling block 19 and hook 25 can be easily calculated based upon the linear speed of cable 21 and the number of cables between crown block 17 and traveling block 19.

In the manner well known to those skilled in the art, the rate of penetration (ROP) of bit 41 may be computed based upon the rate of travel of hook 25 and the time rate of change of the hook weight. Specifically, BIT_ROP=HOOK_ROP+$\lambda$(dF/dT), where BIT_ROP represents the instantaneous rate of penetration of the bit, HOOK_ROP represents the instantaneous speed of hook 25, $\lambda$ represents the apparent rigidity of drill string 31, and dF/dT represents the first derivative with respect to time of the weight on the hook.

While rate of bit rate of penetration is primarily a function of weight on bit, in high friction or highly deviated hole environments, it may be very difficult to determine actual weight on bit from the surface measurements of hook weight and hook speed described above. However, it has been discovered that there is a substantial relationship between weight on bit and pump pressure and rotary torque. Generally, as weight on bit increases, pump pressure and rotary torque also increase. Thus, according to the present invention, weight on bit may be inferred from pump pressure or rotary torque. Additionally, according to the present invention, in situations where accurate determinations of weight on bit are not possible, the optimum rate of penetration may be determined with respect to pump pressure or rotary torque. Accordingly, in addition to hook weight and hook speed/position, the system of the present invention monitors rotary torque and pump or standpipe pressure.

As shown in FIG. 2, the system of the present invention includes a torque sensor 55, which measures the amount of torque applied to the drill string 35 during rotation. Torque has the dimensions of force multiplied by distance. Thus, torque is typically expressed in foot-pounds, or the like. However, in electric rigs, torque is usually indicated by measuring the amount of current drawn by the motor that drives rotary table or top drive. In mechanical rigs, the torque sensor measures the tension in the rotary table drive chain. Those skilled in the art will recognize other torque measuring or indicating arrangements. The system of the present invention also includes a pump pressure sensor 57.

In FIG. 2, each sensor 51–57 produces a digital output at the desired sampling rate that is received at a processor 58. Processor 58 is programmed according to the present invention to process data received from sensors 51–57. Processor 58 receives user input from user input devices, such as a keyboard 59. Other user input devices such as touch screens, keypads, and the like may also be used. Processor 58 provides visual output to a display 60. Processor 58 may also provide output to an automatic driller 61, as will be explained in detail hereinafter.

Figure 3:
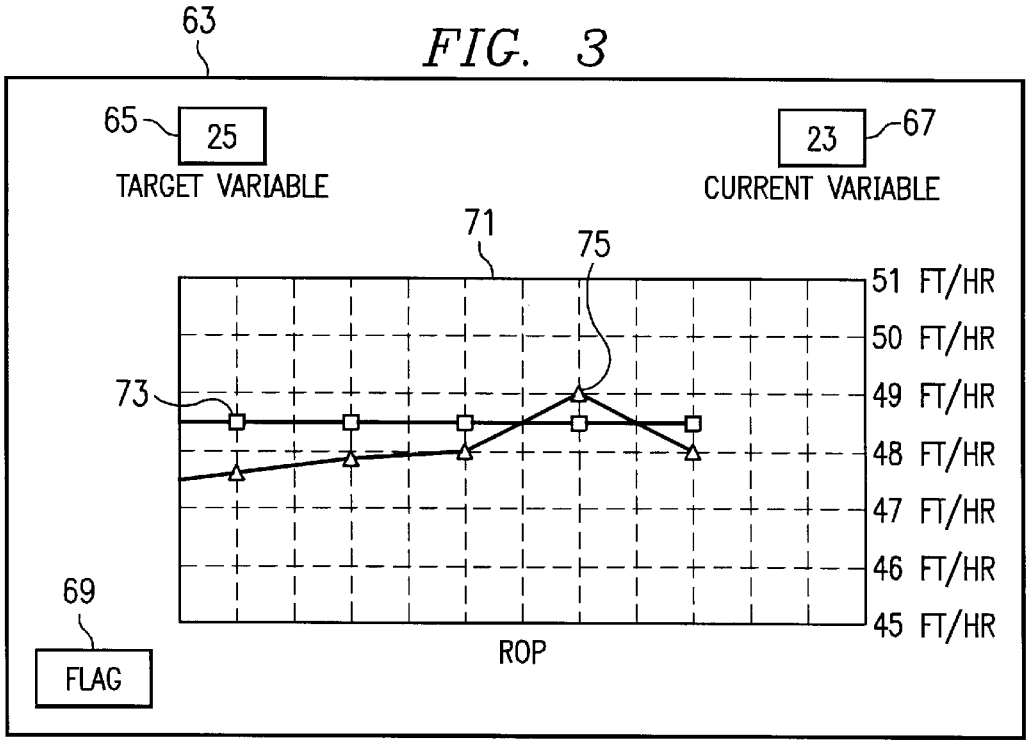
FIG. 3 is an illustration of a screen display according to the present invention.

Referring now to FIG. 3, a display screen according to the present invention is designated by the numeral 63. Display screen 63 includes a target control variable display 65 and a current control variable display 67. The control variables of displays 65 and 67 may be weight on bit, pressure or torque. As will be explained in detail hereinafter, the system displays the control variable (weight on bit, pressure, or torque) that is most closely correlated with rate of penetration. According to the present invention, a target control variable is calculated to achieve a desired rate of penetration. Target control variable display 65 displays the target control variable computed according to the present invention. Current control variable display 67 displays the actual current control variable.

As will be explained in detail hereinafter, the method and system of the present invention constructs mathematical models of the respective relationships between the control variables bit weight, pressure, and torque, and rate of penetration for the current drilling environment. The mathematical model is built from data obtained from sensors 53–57. The method of the present invention selects the control variable with the best correlation to rate of penetration. The present invention calculates, based upon the selected model, a target control variable, which is displayed in target variable display 65. The system of the present invention continuously updates the model to reflect the current drilling conditions.

According to one aspect of the present invention, a driller attempts to match the value displayed in current variable display 67 with the value displayed in target variable display 65 by controlling the brake on the drawworks. If the control variable is weight on bit, the driller increases weight on bit by paying out cable; the driller decreases weight on bit by stopping the drawworks and allowing the weight on bit to be drilled off. Since increases in weight on bit are reflected in increases in pressure and torque, the driller increases pressure or torque also by paying out cable. Thus, regardless of the control variable, the driller pays out cable if the current value is less than the target, and stops the cable if the current value is greater than the target. While in the embodiment of FIG. 3, the target and current control variables are displayed numerically, those variables may also be displayed graphically, by superimposed traces, or the like. In either event, the driller tries to match the current to the target.

According to another aspect of the present invention, the driller may turn control over to automatic driller 61. If the driller has turned control over to automatic driller 61, the driller continues to monitor display 63.

If the model becomes invalid, then a flag 69 will be displayed. Flag 69 indicates that the model does not match the current drilling environment. Accordingly, flag 69 indicates that the drilling environment has changed. The change may be a normal lithological transition from one rock type to another or the change may indicate an emergency or potentially catastrophic condition. When flag 69 is displayed, the driller is alerted to the change in conditions.

Display screen 63 also displays a moving plot 71 of rate of penetration. The target rate of penetration is indicated in plot 71 by squares 73 and the actual rate of penetration is indicated by triangles 75. By matching the current control variable to the target control variable, the plot of actual rate of penetration, indicated by triangles 75, will be closely matched with the plot of target rate of penetration, indicated by squares 73.

Figure 4:
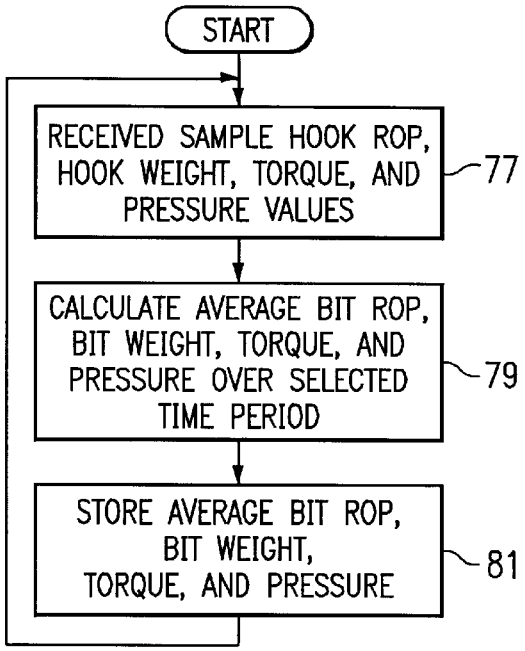
FIG. 4 is a flowchart of data collection and generation according to the present invention.
Figure 5:
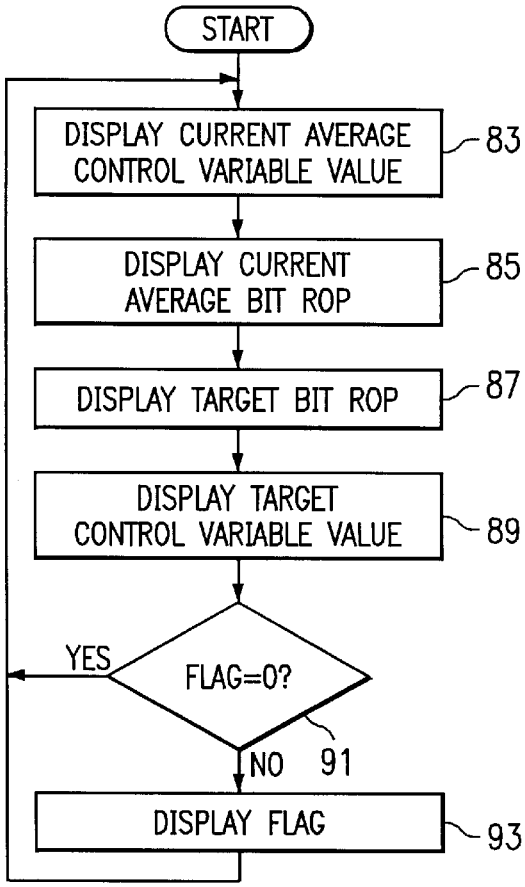
FIG. 5 is a flowchart of display processing according to the present invention.

Referring now to FIGS. 4–6, there are shown flow charts of processing according to the present invention. In the preferred embodiment, three separate processes run in a multitasking environment. Referring to FIG. 4, there is shown a flow chart of the data collection and generation process of the present invention. The system receives sampled hook weight values, hook rate of penetration (ROP) values, torque values, and pressure values from sensors 51–57, at block 77. The preferred sampling rate is five times per second. The system calculates average bit weight, bit rate of penetration (BIT_ROP), torque, and pressure over a selected time period, which in the preferred embodiment is five seconds, at block 79. Then, the system stores the average bit weight, BIT_ROP, torque, and pressure with a time value, at block 81, and returns to block 77.

Referring now to FIG. 5, there is shown display processing according to the present invention. The system displays the current average control variable value, which is calculated at block 79 of FIG. 4, at block 83. The system displays the current average bit ROP, which is also calculated at block 79 of FIG. 4, at block 85. The system displays a target bit ROP at block 87. The target bit ROP is based upon what has been observed and upon what is feasible under the applicable conditions. The system displays the current target control variable, at block 89. The current target control variable is a calculated value, the calculation of which will be explained in detail hereinafter.

The system tests, at decision block 91, if a flag is set to zero. As will be described in detail hereinafter, the flag is set to one whenever an observed bit rate of penetration does not fit the model. If, at decision block 91, the flag is not equal to zero, then the system displays the flag (flag 69 of FIG. 3) at block 93, and processing continues at block 83. If, at decision block 91, the flag is set to zero, then display processing returns to block 83.

Figure 6A:
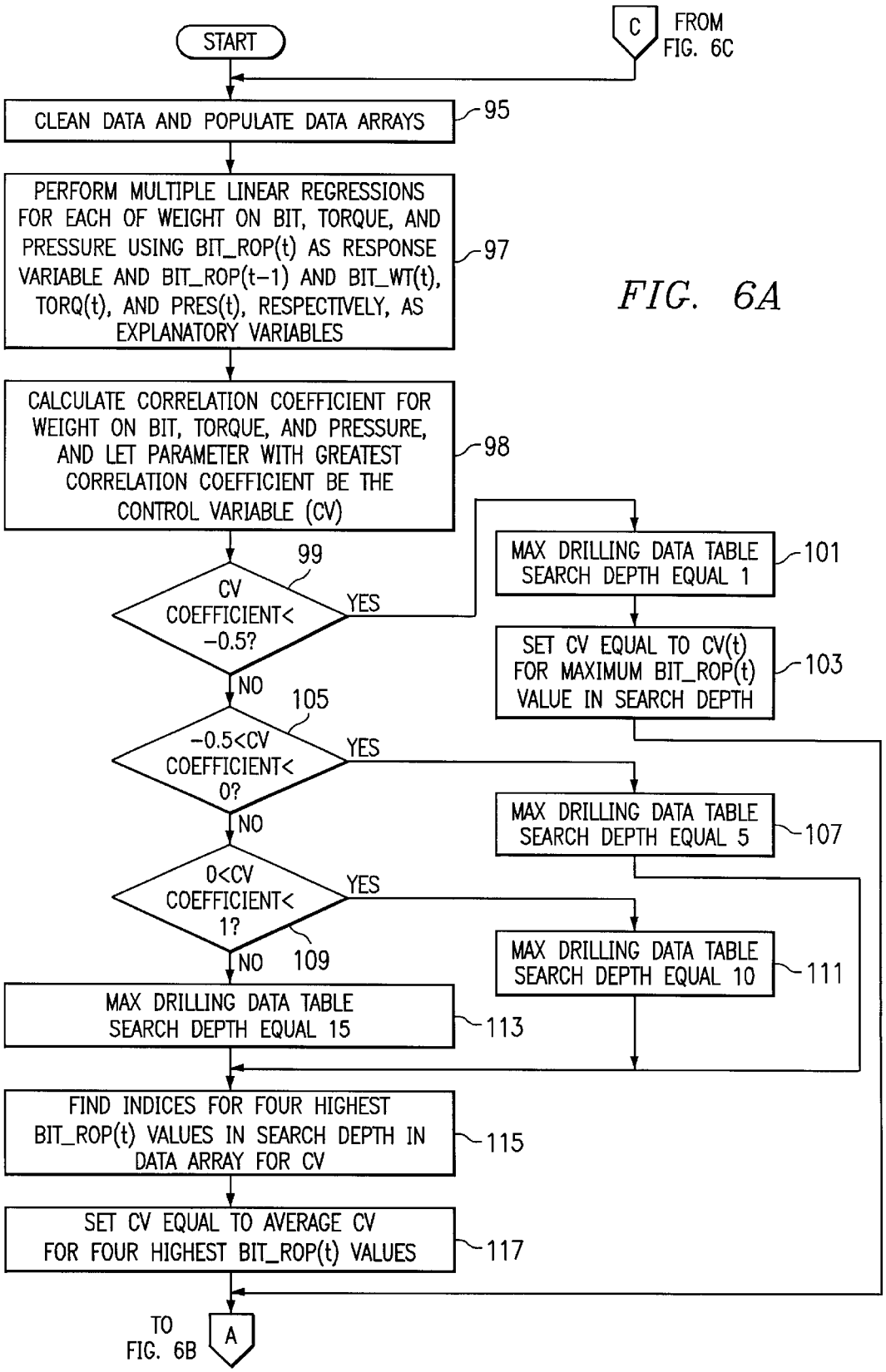
FIGS. 6A–6C comprise a flowchart of drilling model construction and rate of penetration processing according to the present invention.

Referring now to FIG. 6 and particularly to FIG. 6A, there is shown a flow chart of the building of the drilling models and calculation of target rate of penetration and control according to the present invention. In the preferred embodiment, FIG. 4 processing is performed once each five seconds. First, the system cleans the data stored according to FIG. 4 processing and populates appropriate data arrays, at block 95. Data cleaning involves removing zeros and outliers from the data. The clean data are stored in data arrays as illustrated in FIGS. 7A–7C.

Referring to FIGS. 7A–7C, the data arrays each include an index column 99, a control variable column 101, and a bit ROP (BIT_ROP(t)) column 103. Control variable column 101 of FIGS. 7A–7C contain weight on bit (BIT_WT(t)) expressed in kilopounds, pressure (PRES(t)) expressed in pounds per square inch, and torque (TORQ(t)) expressed in Amperes, respectively. Columns 99–103 are populated with data from data cleaning step 95 of FIG. 6A. The data arrays of FIGS. 7A–7C also include a lagged bit ROP (BIT_ROP (t−1)) column 105. In the preferred embodiment, the data arrays of FIGS. 7A–7C each hold up to thirty entries. Thus, the data array contains data for the last two and one-half minutes of drilling.

After populating the data array with clean data, at block 95, the system performs multilinear regression analysis on the data in each of the data arrays, at block 97. The method uses BIT_ROP(t) as the response variable and BIT_ROP (t−1) and BIT_WT(t), PRES(t), and TORQ(t), respectively, as the explanatory variables. Multiple linear regression is a well known technique and tools for performing multilinear regression are provided in commercially available spreadsheet programs, such as Microsoft® Excel® and Corel® Quattro Pro®, or various off-the-shelf statistics software packages. Multiple linear regression produces the mathematical model of the drilling environment, which is an equation of the form:

$$\text{BIT_ROP}(t)=\alpha+\beta_1\text{BIT_ROP}(t-1)+\beta_2\text{CONTROL_VARIABLE}(t), \quad (1)$$

where $\alpha$ is the intercept, $\beta_1$ is the lagged BIT_ROP slope coefficient and $\beta_2$ is the appropriate CONTROL_VARIABLE slope coefficient. Again, CONTROL_VARIABLE is BIT_WT(t), PRES(t), or TORQ(t).

After the system has performed multilinear regression at block 97, the system calculates the correlation coefficients for the parameters BIT_WT, PRES, and TORQ, and selects the parameter with the greatest absolute value correlation coefficient r as the control variable CV, at block 98. As is well known to those skilled in the art, a correlation coefficient r is a number equal to or greater than −1 and equal to or less than +1. If r=+1, there is a perfect positive correlation and all of the points of the distribution lie on a line whose slope is positive. If r=−1, there is a perfect negative correlation and all of the points of the distribution lie on a line whose slope is negative. The correlation coefficient can be calculated by the equation $$r=\frac{\sum(x-\bar{x})(y-\bar{y})/(n-1)}{S_xS_y}$$

where $S_x$ and $S_y$ are the respective sample standard deviations of the observations x and y.

After the system has determined the control variable CV with greatest absolute value correlation coefficient, at block 98, the system searches for a potential optimum control variable CV based upon the appropriate slope coefficient $\beta_2$ Slope coefficient $\beta_2$ represents the slope of the line in the hyper-plane that relates the control variable CV to bit rate of penetration. In the neighborhood around the optimum control variable, the slope $\beta_2$ is about equal to zero. Thus, it is goal of the present invention drill such that control variable slope coefficient $\beta_2$ is close to zero. However, negative control variable slope coefficients $\beta_2$ are to be avoided. The greater the control variable slope coefficient $\beta_2$, the further the system searches into the appropriate data array to find a potential optimum control variable.

The system tests, at decision block 99, if the control variable slope coefficient $\beta_2$ is strongly negative, which in the preferred embodiment is less than negative 0.5. If so, the system sets the maximum data array search depth at one, at block 101. Then the system sets the control variable CV equal to the CV(t) corresponding to the maximum BIT_ROP(t) value in the search depth, at block 103. Since the search depth is one, there is only one candidate CV. If the control variable slope coefficient $\beta_2$ not strongly negative, the system tests, at decision block 105, if the control variable slope coefficient $\beta_2$ is weakly negative, which in the preferred embodiment is between zero and negative 0.5. If so, the system sets the maximum data array search depth equal to five, at block 107. If not, the system tests, at decision block 109, if the control variable slope coefficient $\beta_2$ is weakly to moderately positive, which in the preferred embodiment is between zero and one. If so, the system sets the maximum data array search depth equal to ten, at block 111. If not, which indicates that the control variable slope coefficient $\beta_2$ is strongly positive, the system sets the maximum data array search depth equal to fifteen, at block 113. Then, the system uses the maximum data array search depth set at blocks 107, 111, or 113 to find the indices with the four highest BIT_ROP(t) values, at block 115. Then the system sets the control variable CV equal to the average CV(t) for the four highest BIT_ROP(t) values, at block 117.

Figure 6B:
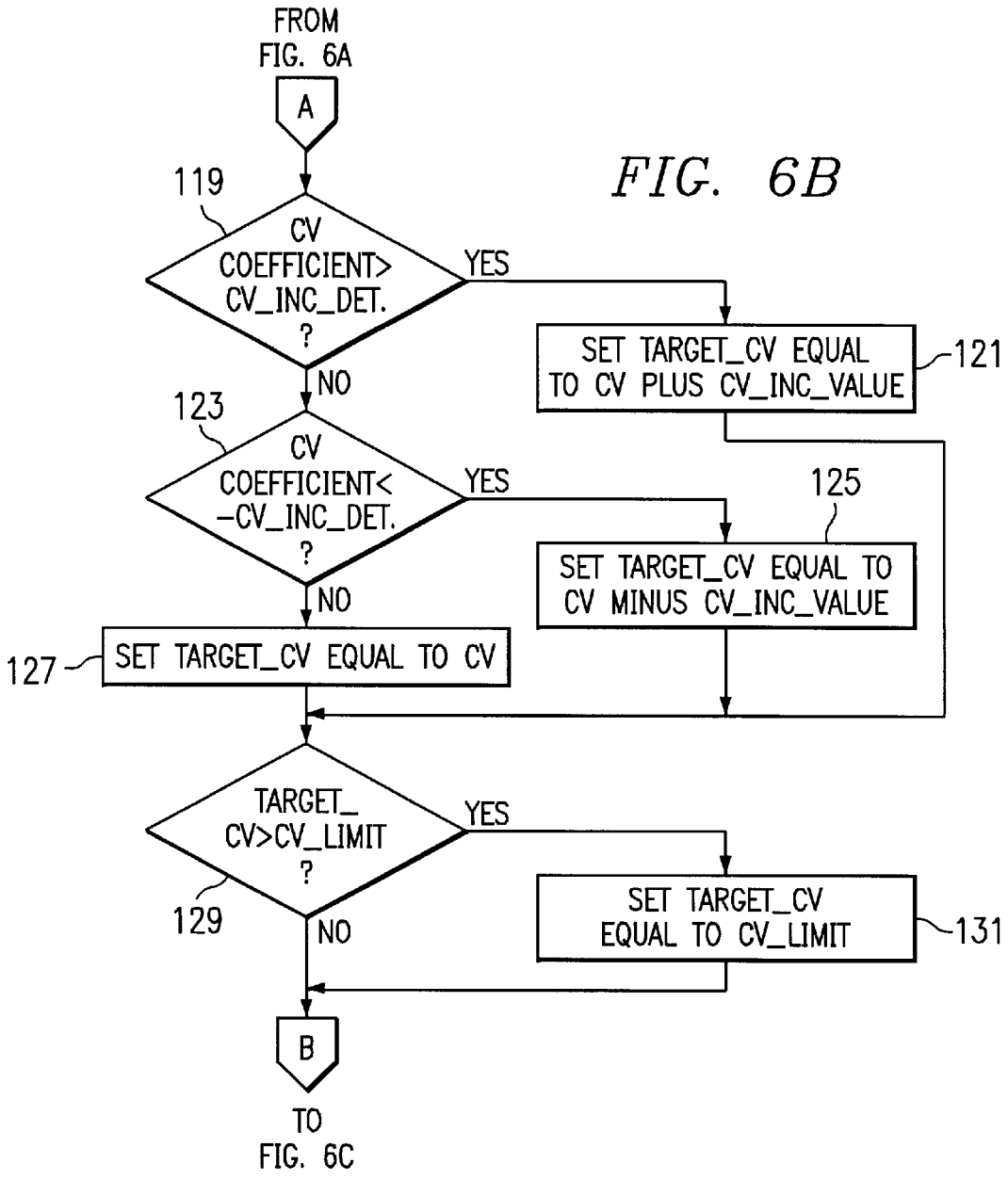

The system then uses the CV value determined at block 103 or block 117 to determine a target control variable TARGET_CV based upon the control variable slope coefficient $\beta_2$. Referring to FIG. 6B, the system tests, at decision block 119, if the control variable slope coefficient $\beta_2$ is greater than a positive control variable incrementer determiner. The incrementer determiner is selected to keep the control variable slope coefficient $\beta_2$ in the neighborhood of zero. In the preferred embodiment, the incrementer determiner is 0.15. If the control variable slope coefficient $\beta_2$ is greater than the incrementer determiner, then the system sets the target control variable TARGET_CV equal to the CV determined at blocks 103 or 117 plus an appropriate control variable increment value CV_INC_VALUE, at block 121. In the preferred embodiment, and where the control variable is weight on bit, the weight on bit incrementer WOB_INC_VALUE is equal to one thousand pounds. If the control variable slope coefficient $\beta_2$ is not greater than the incrementer determiner, the system tests, at decision block 123, if CV slope coefficient $\beta_2$ is less (more negative) than the negative control variable incrementer determiner. If so, the system sets the target control variable TARGET_CV equal to the CV determined at blocks 103 or 117 minus the control variable increment value CV_INC_VALUE, at block 125. If the CV slope coefficient $\beta_2$ is between the positive control variable incrementer determiner and the negative control variable incrementer determiner, the system sets, at block 127, TARGET_CV equal to the CV determined at blocks 103 or 117.

The target control variable determined at blocks 121, 125, or 127, may be greater than a preset control variable limit CV_LIMIT. CV_LIMIT is set according to engineering and mechanical considerations. The system tests, at decision block 129, if TARGET_CV is greater than the CV_LIMIT. If so, the system sets TARGET_CV equal to the CV_LIMIT, at block 131.

Figure 6C:
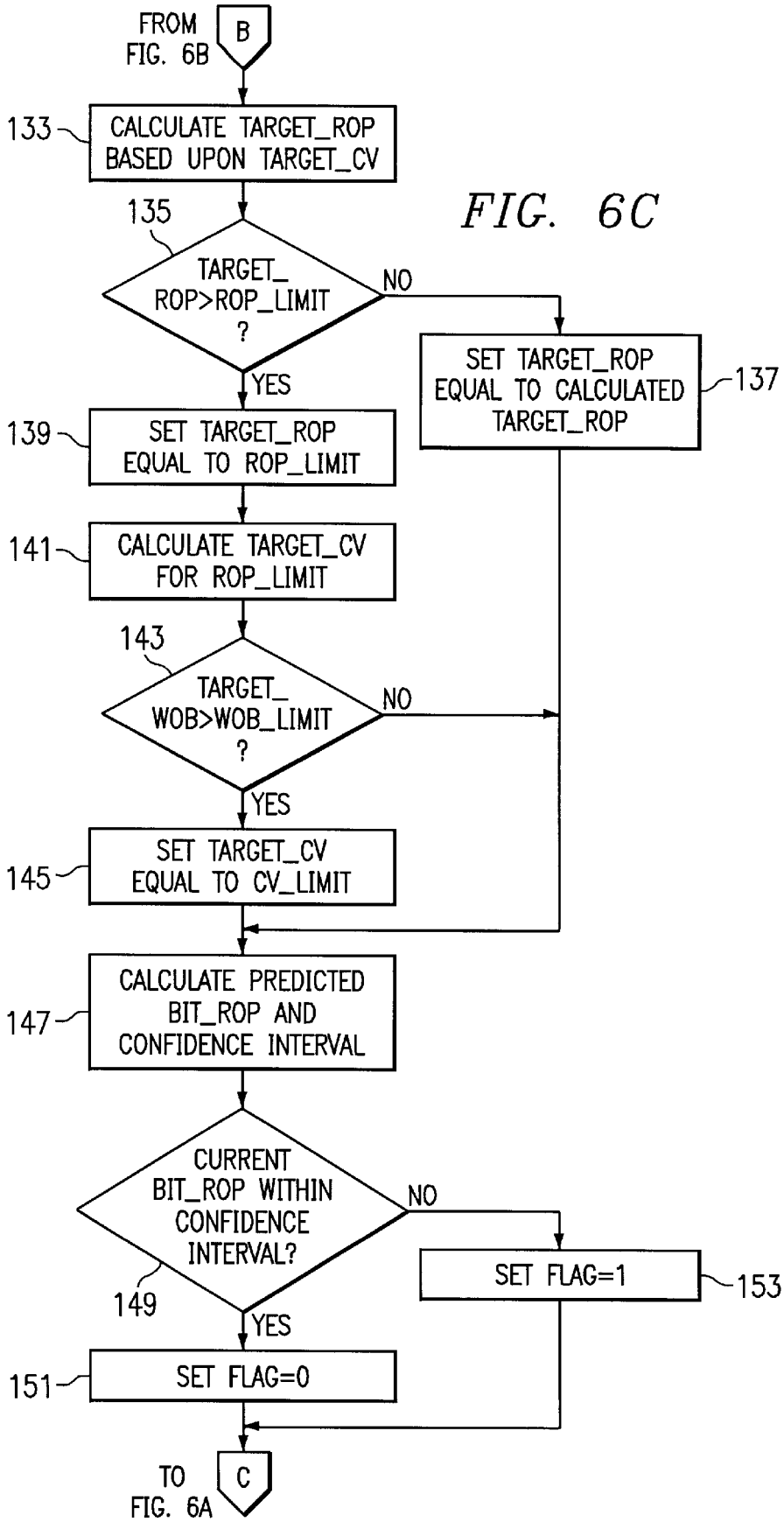

Referring now to FIG. 6C, after determining TARGET_CV, the system calculates a target rate of penetration TARGET_ROP based upon TARGET_CV and the model of equation (1), at block 133. There are engineering reasons for limiting rate of penetration. For example, the drilling fluid system may be able to remove cuttings at a certain rate. Drilling above a certain rate of penetration may produce cuttings at a rate greater than the ability of the fluid system to remove them. Accordingly, in the present invention there is a preset rate of penetration limit ROP_LIMIT. ROP_LIMIT may be the theoretical maximum rate of penetration, or some percentage, for example 95%, of the theoretical maximum. The system tests, at decision block 135, if the TARGET_ROP is greater than the ROP_LIMIT. If not, the system sets the TARGET_ROP equal to the calculated TARGET_ROP, at block 137. If the calculated TARGET_ROP is greater than the ROP_LIMIT, then the system sets the TARGET_ROP equal to the ROP_LIMIT, at block 139. Then the system calculates a TARGET_CV based upon the ROP_LIMIT and the model of equation (1), at block 141, and tests, at decision block 143, if the TARGET_CV calculated at block 141 is greater than CV_LIMIT. If so, the system sets TARGET_CV equal to the CV_LIMIT, at block 145.

After completing steps 137 or 145, the system calculates a predicted BIT_ROP(t) and confidence interval at block 147. The forecasted BIT_ROP(t) is calculated by solving equation (1) for the actual current control variable Cv(t) and BIT_ROP(t−1). The system tests, at decision block 149, if the current BIT_ROP is within the confidence interval. If so, the system sets the flag to zero at block 151 and processing returns to block 95 of FIG. 6A. If, at decision block 149, the current BIT_ROP is not within the confidence interval, the system sets the flag to 1, at block 153.

From the foregoing, it may be seen that the present invention is well adapted to overcome the shortcomings of the prior art. The system determines a control variable that is best correlated with rate of penetration in the current drilling environment. The system builds a mathematical model of the relationship between control variable and rate of penetration for the current drilling environment. The system continuously updates the mathematical model to reflect changes in the drilling environment. The system uses a drilling model to determine a target control variable to produce an optimum rate of penetration. The driller attempts to match the actual control variable value to the target control variable value, thereby optimizing rate of penetration.

What is claimed is:

1. A method of optimizing bit rate of penetration while drilling, which comprises the steps of:

substantially continuously collecting bit rate of penetration and data for a plurality of drilling parameters during drilling;

periodically determining a control variable while drilling, said control variable being the one of said drilling parameters best correlated with rate of penetration;

periodically determining an optimum value for said control variable to achieve an optimum rate of penetration; and, attempting to maintain said control variable at said optimum value.

2. The method as claimed in claim 1, wherein said step of determining said optimum value includes the steps of:

periodically performing a linear regression with bit rate of penetration as a response variable and said control variable as an explanatory variable to produce a control variable slope coefficient;

periodically searching said data to determine at least one maximum rate of penetration; and, setting said optimum value based upon said at least one maximum rate of penetration and said control variable slope coefficient.

3. The method as claimed in claim 2, wherein said step of setting said optimum value includes the step of:

setting said optimum value at the control variable value associated with said at least one maximum rate of penetration in said data if said control variable slope coefficient is in a selected range near zero.

4. The method as claimed in claim 2, wherein said step of setting an optimum value includes the step of:

setting said optimum value at the control variable value associated with said at least one maximum rate of penetration in said data plus a selected increment if said control variable slope coefficient is greater than a selected positive value.

5. The method as claimed in claim 2, wherein said step of setting an optimum value includes the step of:

setting said optimum value at the control variable associated with said at least one maximum rate of penetration in said data minus a selected increment if said control variable slope coefficient is less than a selected negative value.

6. The method as claimed in claim 2, wherein said step of periodically searching said data includes the steps of:

determining a depth of search based upon said control variable slope coefficient; and, searching said data to said depth of search.

7. The method as claimed in claim 6, wherein said step of periodically searching said data includes the step of determining a selected number of maximum rates of penetration within said depth of search.

8. The method as claimed in claim 7, including the steps of:

determining the control variable value associated in said array with each of said selected number of maximum rates of penetration within said depth of search; and, averaging said control variables associated with said selected maximum rates of penetration to determine an average control variable value.

9. The method as claimed in claim 8, wherein said step of setting an optimum control variable value includes the step of:

setting said optimum control variable at said average control variable value if said control variable slope coefficient is in a selected range near zero.

10. The method as claimed in claim 8, wherein said step of setting an optimum control variable value includes the step of:

setting said optimum control variable value at said average control variable value plus a selected increment if said control variable slope coefficient is greater than a selected positive value.

11. The method as claimed in claim 8, wherein said step of setting an optimum control variable value includes the step of:

setting said optimum control variable value at the control variable value associated with said average control variable value minus a selected increment if said control variable slope coefficient is less than a selected negative value.

12. The method as claimed in claim 1, wherein said drilling parameters include weight on bit, pressure, and torque.

13. The method as claimed in claim 1, wherein said step of periodically determining said control variable includes the step of calculating a correlation coefficient for each of said drilling parameters.

14. A method of optimizing bit rate of penetration while drilling, which comprises the steps of:

substantially continuously collecting bit rate of penetration data and data for a plurality of drilling parameters during drilling;

storing bit rate of penetration and drilling parameter data in a plurality of data arrays;

periodically determining a control variable, said control variable being the one of said drilling parameters best correlated with said rate of penetration data;

periodically determining a relationship between said bit rate of penetration and said control variable data stored in the data array for said control variable, said relationship being defined by a control variable slope coefficient;

periodically searching said data array associated with said control variable to a depth of search related to said control variable slope coefficient;

determining at least one maximum rate of penetration within said depth of search; and, setting an optimum control variable value based upon said at least one maximum rate of penetration and said control variable slope coefficient.

15. The method as claimed in claim 14, wherein said step of setting an optimum control variable includes the step of:

setting said optimum control variable value at the control variable value associated with said at least one maximum rate of penetration in said data array if said control variable slope coefficient is in a selected range near zero.

16. The method as claimed in claim 14, wherein said step of setting an optimum control variable value includes the step of:

setting said optimum control variable value at the control variable value associated with said at least one maximum rate of penetration in said data array plus a selected increment if said control variable value slope coefficient is greater than a selected positive value.

17. The method as claimed in claim 14, wherein said step of setting an optimum control variable value includes the step of:

setting said optimum control variable value at the control variable value associated with said at least one maximum rate of penetration in said data array minus a selected increment if said control variable value slope coefficient is less than a selected negative value.

18. The method as claimed in claim 14, wherein said step of periodically searching said data array includes the step of determining a selected number of maximum rates of penetration within said depth of search.

19. The method as claimed in claim 16, including the steps of:

determining the control variable value associated in said data array with each of said selected number of maximum rates of penetration within said depth of search; and, averaging said weights on bit associated with said selected maximum rates of penetration to determine an average control variable value.

20. The method as claimed in claim 19, wherein said step of setting an optimum control variable value includes the step of:

setting said optimum control variable value at said average control variable value if said control variable slope coefficient is in a selected range near zero.

21. The method as claimed in claim 19, wherein said step of setting an optimum control variable value includes the step of:

setting said optimum control variable value at said average control variable value plus a selected increment if said control variable value slope coefficient is greater than a selected positive value.

22. The method as claimed in claim 19, wherein said step of setting an optimum control variable value includes the step of:

setting said optimum control variable value at the control variable value associated with said average control variable value minus a selected increment if said control variable value slope coefficient is less than a selected negative value.

* * * * *